US008475287B2

(12) United States Patent
Gray et al.

(10) Patent No.: US 8,475,287 B2
(45) Date of Patent: Jul. 2, 2013

(54) SYSTEM AND METHOD FOR AUTOMATICALLY ALTERING A THEME ASSOCIATED WITH A ROOM OR SIMILAR SPACE

(75) Inventors: Rick Gray, Las Vegas, NV (US); William B. Gorlin, Briarcliff Manor, NY (US); Stephen A. Sywak, Cornwall, NY (US); Murphy Gigliotti, Brooklyn, NY (US); Frederick L. Smith, Park Ridge, NJ (US); Jean Labadie, Laval (CA)

(73) Assignee: Wynn Resorts Holdings, LLC, Las Vegas, NV (US)

( * ) Notice: Subject to any disclaimer, the term of this patent is extended or adjusted under 35 U.S.C. 154(b) by 0 days.

(21) Appl. No.: 13/115,872

(22) Filed: May 25, 2011

(65) Prior Publication Data

US 2011/0224006 A1 Sep. 15, 2011

Related U.S. Application Data

(62) Division of application No. 12/341,613, filed on Dec. 22, 2008, now Pat. No. 8,025,582.

(51) Int. Cl.
*A63J 1/02* (2006.01)
*E04B 1/346* (2006.01)

(52) U.S. Cl.
USPC ..... 472/77; 472/57; 472/75; 40/427; 40/436; 52/311.1; 52/64; 52/72; 52/311.3; 160/334

(58) Field of Classification Search
USPC ..... 52/6, 7, 11, 66, 65, 68–72, 311.1, 52/311.2, 311.3, 204.1, 9, 64, 67, 210–213; 472/92, 77, 68, 76, 57, 75; 359/443, 461; 160/197, 330–341, 377; 40/411, 427, 436, 40/460
See application file for complete search history.

(56) References Cited

U.S. PATENT DOCUMENTS

| | | | | |
|---|---|---|---|---|
| 1,862,824 | A | 6/1932 | Howard | |
| 3,083,418 | A * | 4/1963 | Reames | 52/63 |
| 3,084,933 | A | 4/1963 | Alswang | |
| 3,247,628 | A * | 4/1966 | Miller | 52/6 |
| 3,289,740 | A | 12/1966 | Heier, Jr. | |
| 3,348,603 | A | 10/1967 | Ford | |
| 3,558,102 | A | 1/1971 | Cruse | |
| 3,824,987 | A * | 7/1974 | Howorth | 600/21 |
| 3,986,703 | A | 10/1976 | Brett et al. | |
| 4,035,965 | A | 7/1977 | Ronai | |

(Continued)

FOREIGN PATENT DOCUMENTS

| | | | |
|---|---|---|---|
| JP | 2011144607 | A * | 7/2011 |
| NL | 7312774 | A * | 3/1975 |
| WO | WO 9012630 | A1 * | 11/1990 |

*Primary Examiner* — Jeanette E. Chapman
(74) *Attorney, Agent, or Firm* — Greenberg Traurig

(57) ABSTRACT

A method for changing a theme associated with a given space (e.g., restaurant). A wall system includes a wall panel having multiple themes depicted thereon or multiple wall panels each having a theme depicted thereon. Using a series of winches, chain drives, cables and pulleys or the like, the wall panels are moved to change the theme of the space. A ceiling system includes two ceiling panels movable via a series of winches, chain drives, cables and pulleys. Once separated the ceiling panels expose a theme different than that depicted while closed. Audio and/or visual cues may be provided to alert patrons to a theme change.

14 Claims, 22 Drawing Sheets

U.S. PATENT DOCUMENTS

| | | | | |
|---|---|---|---|---|
| 4,367,604 | A | 1/1983 | Porter et al. | |
| 4,607,401 | A * | 8/1986 | Sisson | 5/414 |
| 4,662,628 | A | 5/1987 | Chatenay epouse Compagnone | |
| 4,726,503 | A | 2/1988 | Bowker | |
| 4,764,142 | A | 8/1988 | Griffith et al. | |
| 4,962,420 | A | 10/1990 | Judenich | |
| 5,004,225 | A | 4/1991 | Krukovsky | |
| 5,121,977 | A * | 6/1992 | Weisgerber | 359/450 |
| 5,140,461 | A | 8/1992 | Blood et al. | |
| 5,327,698 | A * | 7/1994 | Uhl | 52/68 |
| 5,400,551 | A * | 3/1995 | Uhl | 52/68 |
| 5,813,168 | A * | 9/1998 | Clendening | 47/17 |
| 6,267,169 | B1 * | 7/2001 | McDonald | 160/193 |
| 6,718,696 | B2 | 4/2004 | Silberman et al. | |
| 7,014,524 | B2 * | 3/2006 | Farmer Brock et al. | 446/82 |
| 2008/0233546 | A1 | 9/2008 | Baker et al. | |

* cited by examiner

FIG. 3A
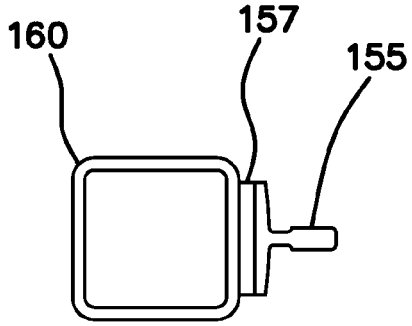
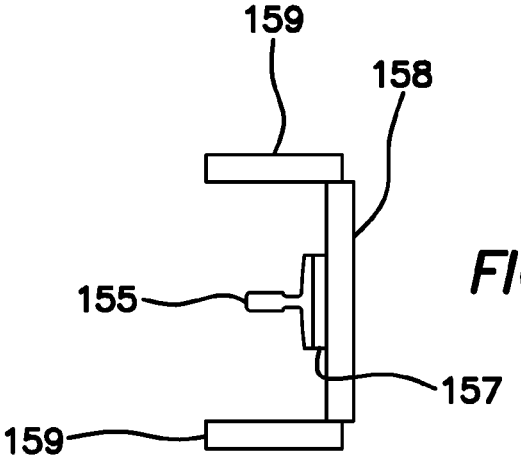
FIG. 3B
FIG. 4
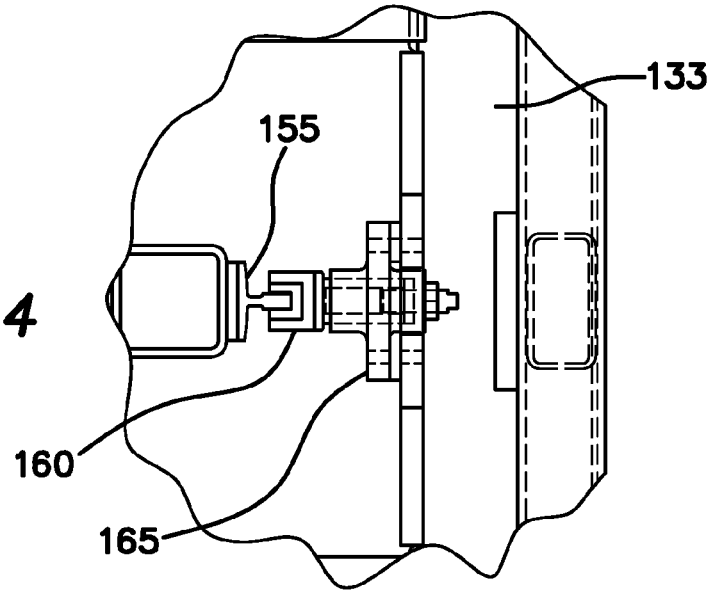

FIG. 7F
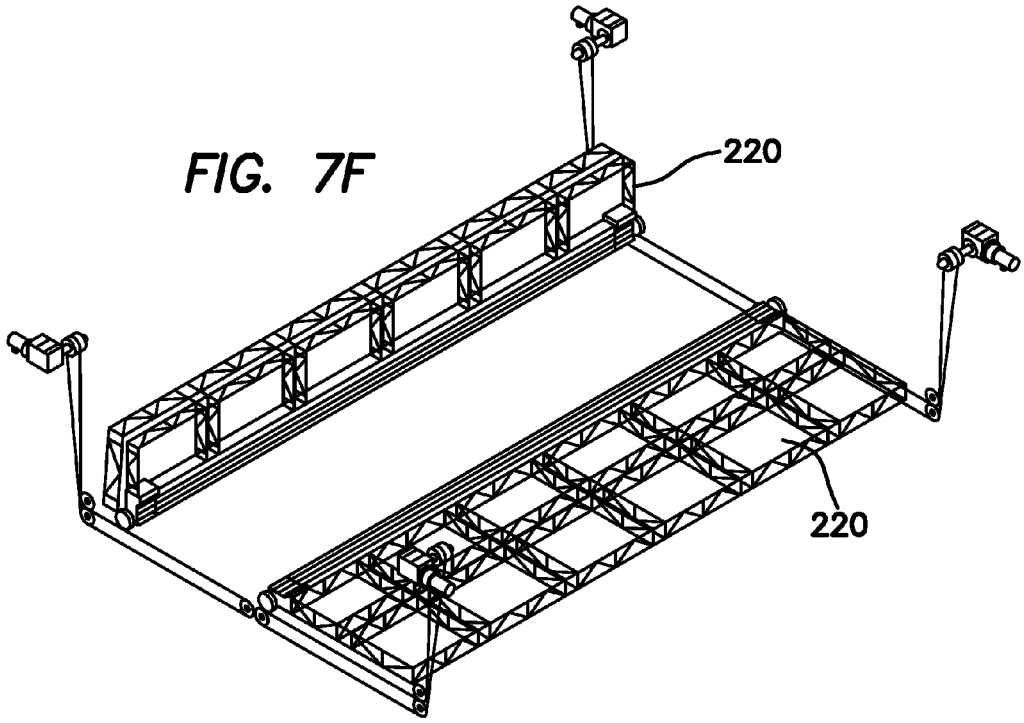
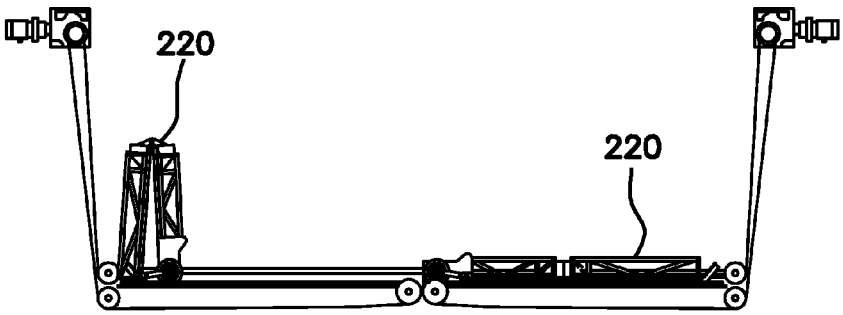
FIG. 7G

FIG. 7J
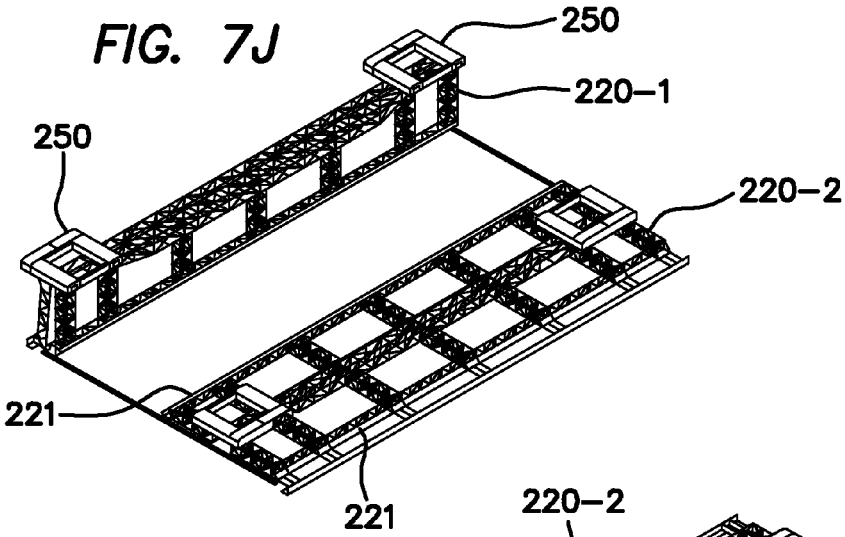
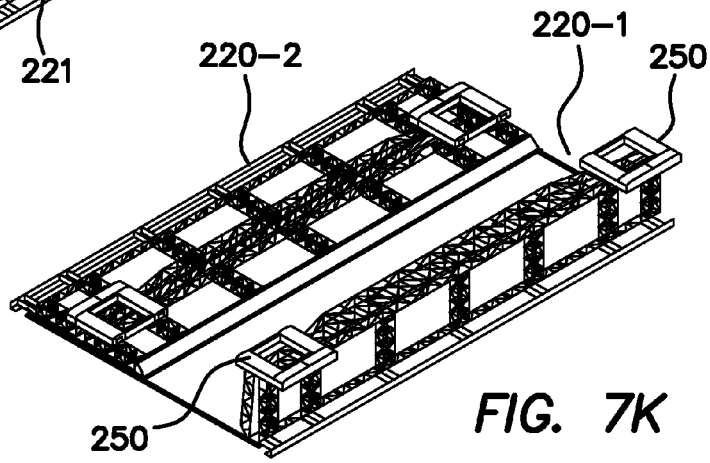
FIG. 7K
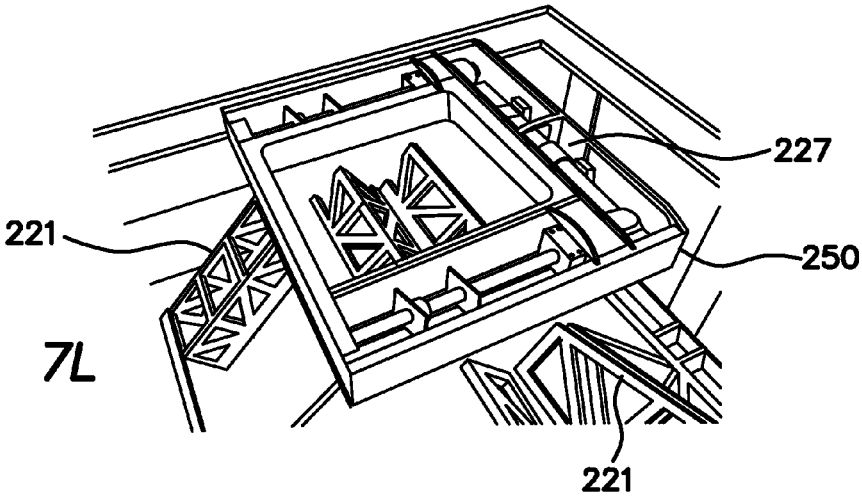
FIG. 7L

SYSTEM AND METHOD FOR AUTOMATICALLY ALTERING A THEME ASSOCIATED WITH A ROOM OR SIMILAR SPACE

CROSS REFERENCE TO RELATED APPLICATIONS

This application is a divisional application of U.S. patent application Ser. No. 12/341,613 filed on Dec. 22, 2008 now U.S. Pat. No. 8,025,582.

FIELD OF THE INVENTION

The embodiments of the present invention relate to an automated system for changing the theme of a room or similar space (e.g., a restaurant).

BACKGROUND

Restaurants have themes and/or ambiances which make each one unique. For example, a nice steakhouse may use rich dark woods with vibrant colors while a Mexican restaurant may use southwestern artifacts with desert colors. Such themes attract patrons and provide a form of entertainment or distraction prior to food being served and after food has been eaten. Changing the theme of a restaurant is time consuming and expensive. Consequently, restaurant themes are rarely, if ever, changed resulting in a stale atmosphere for repeat patrons.

It would be advantageous to be able to quickly change a theme and/or ambiance associated with a restaurant or other space. It would be further advantageous to be able to change a theme and/or ambiance associated with a restaurant or other space while patrons are in the space. It would be further advantageous to be able to quickly change a theme and/or ambiance associated with a restaurant or other space in an automated manner.

SUMMARY

Accordingly, a first embodiment of the present invention is a system for changing a theme of a space comprising: one or more moving wall systems, each said moving wall system having a wall panel wherein said wall panel depicts or supports at least two different wall designs each wall design dimensioned to reside in a viewable section associated with said space; and means for moving said wall panel to selectively position each of said one or more different wall designs into said viewable section.

Another embodiment of the present invention is a system for changing a theme of a space comprising: one or more moving wall systems, each said moving wall system having two or more wall panels wherein each said wall panel depicts or supports a different wall design with each wall design dimensioned to reside in a viewable section associated with said space; and means for moving each of said wall panels to selectively position each of said different wall designs in said viewable section.

Another embodiment of the present invention is a ceiling system comprising: two ceiling panels hinged to one another with multiple hinges; one of said ceiling panels having wheels on each end thereof, said wheel positioned to glide along a guide track, said other ceiling panel fixed along one side; and means for folding said two ceiling panels about said multiple hinges.

Another embodiment of the present invention is a system for changing a theme of a space comprising: one or more moving ceiling systems, each moving ceiling system having at least two ceiling panels with a first ceiling panel hinged to a second ceiling panel near a mid-point; and means for opening said at least two ceiling members such that said at least two ceiling members each bend near said mid-point and separate to expose an area thereabove.

Another embodiment of the present invention is a system for changing a theme of a space comprising: one or more moving ceiling systems, each moving ceiling system having at least two ceiling panels with a first ceiling panel hinged to a second ceiling panel near a mid-point; and a driving system attached to at least one of said ceiling panels for opening said at least two ceiling members such that said at least two ceiling members each bend near said mid-point and separate to expose an area thereabove.

Another embodiment of the present invention is a method of changing a theme of a space comprising: selectively positioning a wall panel such that a first wall design of at least two wall designs on said wall panel resides in a viewable section associated with said space and a second wall design is out of view; and selectively positioning said wall panel such that said second wall design resides in a viewable section and said first wall design is out of view.

The embodiments of the present invention allow a theme associated with a given space (e.g., restaurant) to be changed automatically or manually very quickly. Moving walls and ceilings provide for such theme changes to be accomplished quickly and while patrons are in the space.

Other variations, embodiments and features of the present invention will become evident from the following detailed description, drawings and claims.

BRIEF DESCRIPTION OF THE DRAWINGS

FIGS. 3*a* and 3*b* illustrate upper views of two types of columns used to support the walls according to the embodiments of the present invention;

FIG. 4 illustrates a top view of a wall incorporating the system of the embodiments of the present invention;

FIGS. 7*a*-7*i* illustrate a first moving ceiling system according to the embodiments of the present invention;

FIGS. 7*j*-7*m* illustrate a second moving ceiling system according to the embodiments of the present invention;

DETAILED DESCRIPTION

It will be appreciated by those of ordinary skill in the art that the invention can be embodied in other specific forms without departing from the spirit or essential character thereof. The presently disclosed embodiments are therefore considered in all respects to be illustrative and not restrictive.

The embodiments of the present invention are described relative to a restaurant space but those skilled in the art will recognize that the embodiments of the present invention are not so limited. Indeed, any space having walls and/or a ceiling with a desire for the walls to be changed and/or the ceiling to be altered automatically or manually is suitable for the embodiments of the present invention. While not exhaustive, other examples include banquet halls, hotel rooms, card rooms, bars, offices, clubs and casinos.

With a restaurant space, in one embodiment of the present invention, it is envisioned that the walls will be changed routinely as established by a pre-established time interval. Similarly, the ceiling will be modified, moved or otherwise changed routinely as established by a pre-established time interval. In this manner, dining patrons are entertained as the theme and/or ambiance of the restaurant is changed one or more times during a meal service.

Figure 1:
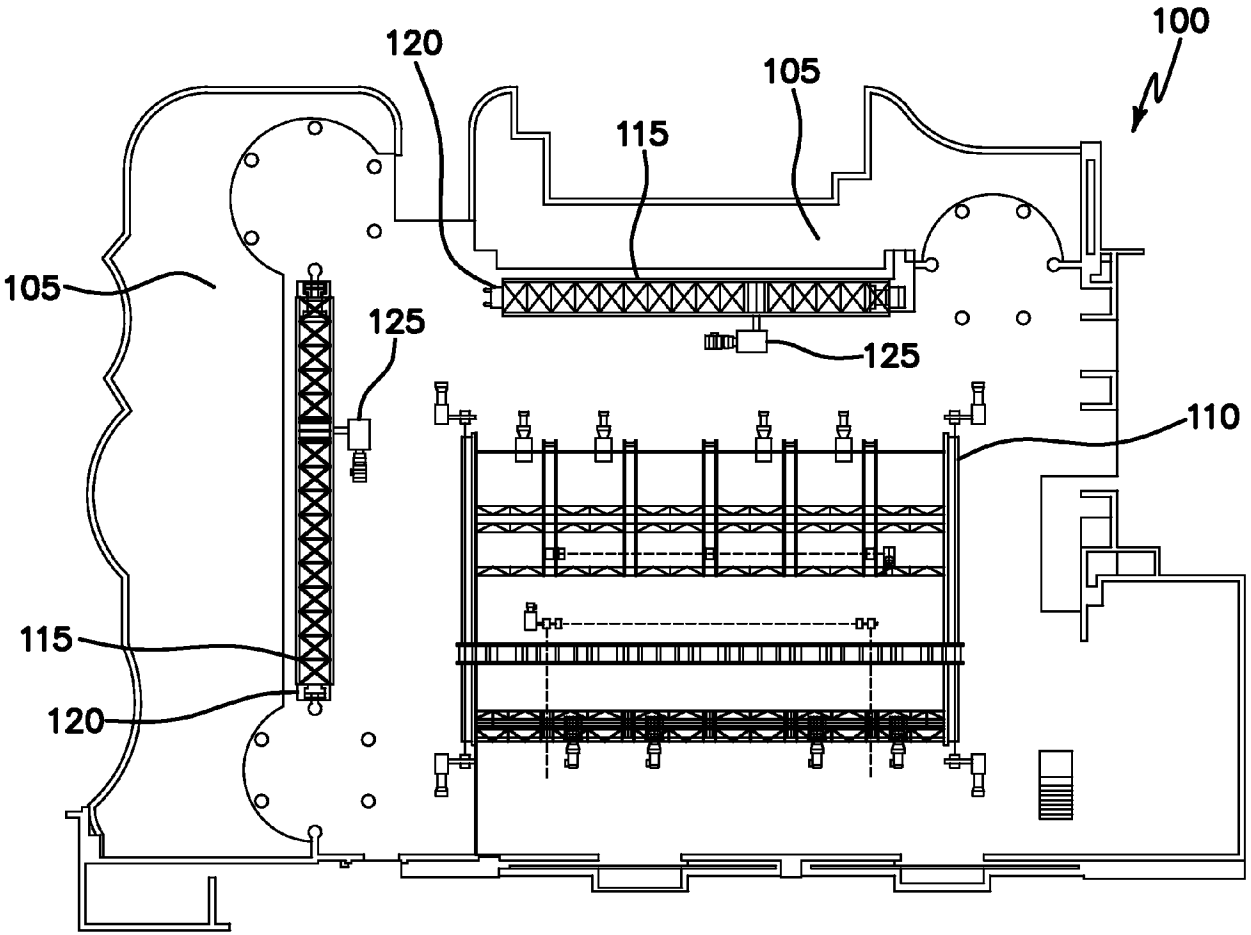
FIG. 1 illustrates an overhead view of a restaurant space incorporating a system according to the embodiments of the present invention.

Initial reference is made to FIG. 1 illustrating an overhead view of a restaurant space generally denoted by reference numeral 100 along with two wall systems 105 and a ceiling system 110. It will understood by those skilled in the art that more or less than two wall systems 105 and more than a single ceiling system 110 may be utilized in an identified space. As described in great detail below, the two wall systems 105 are responsible for moving two or more differently-themed walls into and out of the visible portion or section associated with the space while the ceiling system 110 is responsible for reconfiguring the ceiling and/or fixtures adjacent or attached thereto.

Figure 2A:
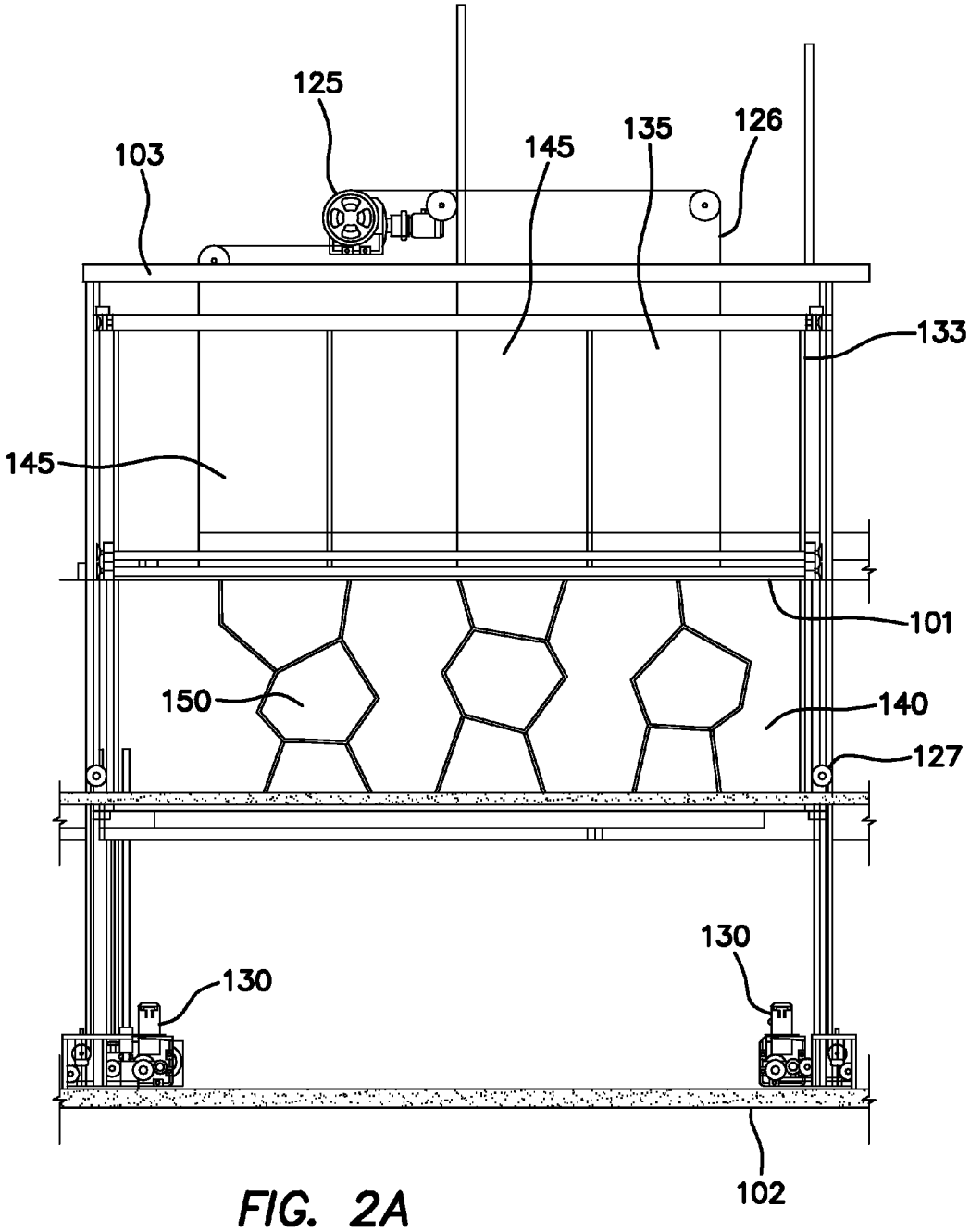
FIGS. 2*a* and 2*b* illustrate a front view of one restaurant wall incorporating the system according to the embodiments of the present invention.
Figure 2B:
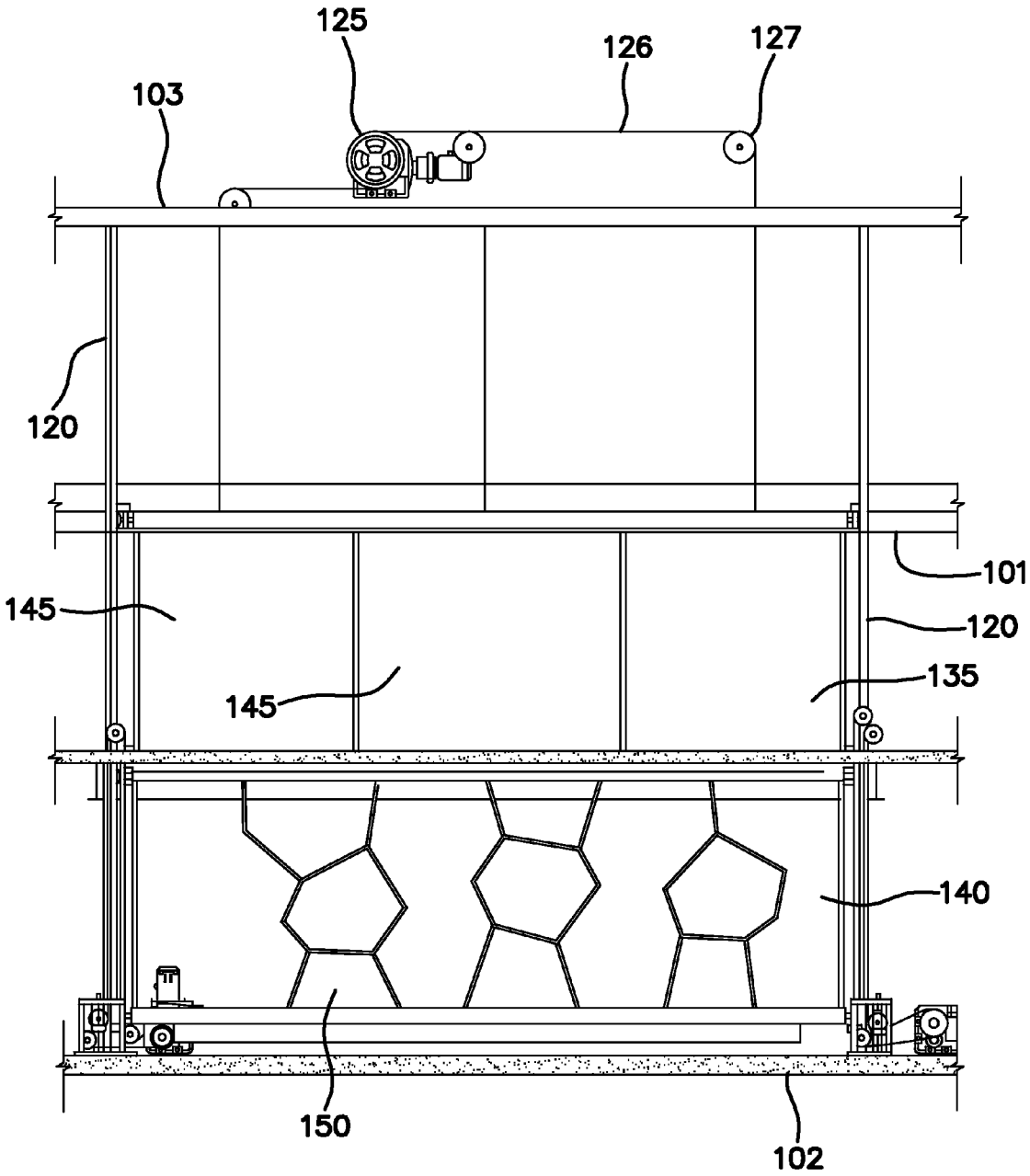

As shown in FIG. 1, each wall system 105 includes a truss support 115, wall support columns 120 and winch 125. FIGS. 2*a* and 2*b* illustrate a front view of one restaurant wall according to the embodiments of the present invention. As shown in FIGS. 2*a* and 2*b*, each wall system 105 further includes a pair of chain drives 130, and a wall panel 133 comprising an upper wall design 135 and a lower wall design 140. It will be understood by those skilled in the art that a single wall panel 133 may include more than two wall designs. The chain drives 130 are positioned on a basement floor 102 or similar lower floor area while the winch 125 is positioned on a catwalk 103. As shown in FIG. 2*a*, the upper wall design 135 is positioned above the ceiling 101, preferably out of view of restaurant patrons. The lower wall design 140 is in the restaurant space and viewable by patrons. The upper wall design 135 depicts a generic pattern in the form of separate partitioned areas 145 while the lower wall design 140 depicts various stone patterns 150. Cables 126 and pulleys 127 in combination with said winches 125 and chain drives 130 provide means for moving and positioning said upper wall design 135 and lower wall design 140 as desired.

Figure 6A:
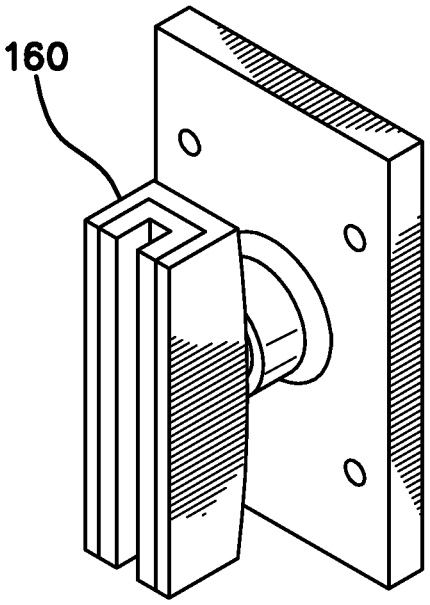
FIGS. 6*a* and 6*b* illustrate a perspective and upper view, respectively, of a guide shoe according to the embodiments of the present invention.
Figure 6B:
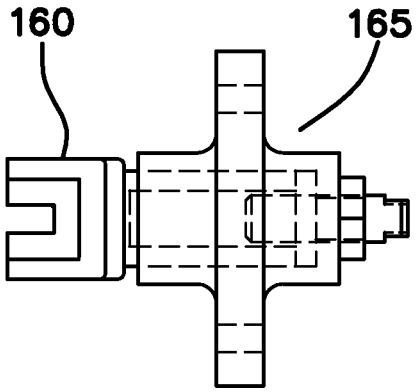

FIGS. 3*a* and 3*b* show two different column configurations supportive of said wall panel 133. FIG. 3*a* shows a guide rail 155 attached to column 160 via mounting plate 157. FIG. 3*b* shows a guide rail 155 attached to an intermediate plate 158 via mounting plate 157 along with two parallel support/guide plates 159. With both configurations, multiple guide rails 155 guide the wall panel 133 during motion or movement. In one embodiment, as shown in FIG. 4, the guide rails 155 insert into guide shoes 160 (also shown in FIGS. 6*a*-6*b*) attached to a guide shoe mounting base 165 attached to the wall panel 133. Brakes 170 provide means to stop said wall panel 133 when in the desired position and/or prevent said wall panel 133 from inadvertently moving and being damaged or causing injury.

Figure 5:
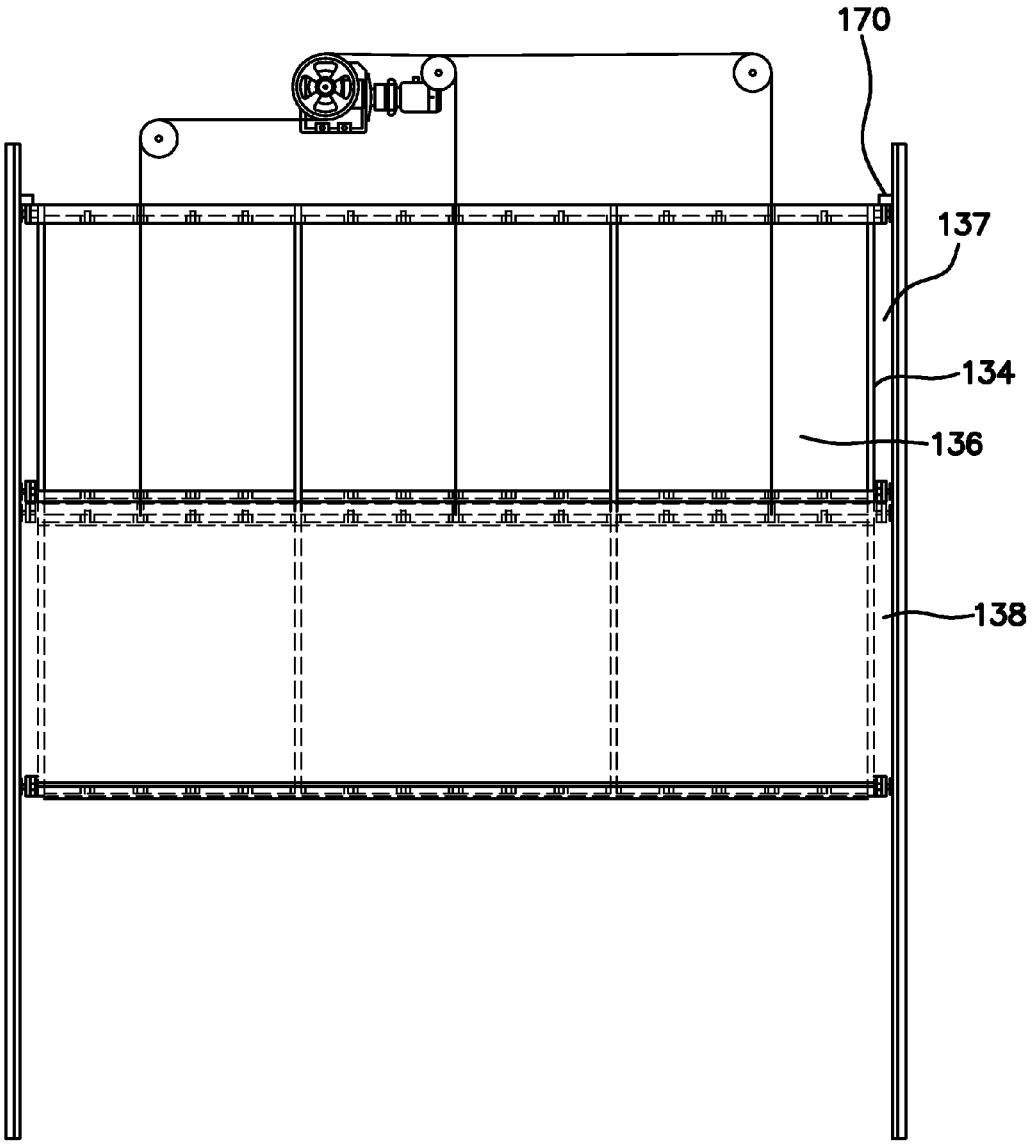
FIG. 5 illustrates a front view of a wall panel in multiple positions according to the embodiments of the present invention.

While the different wall designs 135, 140 have been depicted on a single wall panel 133, it is understood that a wall system may comprise multiple wall panels with each wall panel depicting a different theme. In such an embodiment, the wall panels may be positioned adjacent to one another like a deck of cards. When desired, a first wall panel depicting a first theme may be lowered or raised out of the viewable section of the space with a new wall panel depicting a second theme raised or lowered into the viewable section of the space. FIG. 5 shows a single wall panel 134 with a single wall design 136 in a raised position 137 and lowered position 138. In the lowered position 138, the wall design 136 is viewable in the restaurant or other structure space section (i.e., in the viewable section). In the raised position, the wall design 136 is out of view. In this embodiment, multiples of such wall panels 133 may be positioned behind one another.

To prevent injuries, a system of optical sensors (not shown), photo eyes and/or similar sensors monitor the presence of foreign objects (e.g., limbs) near the walls immediately prior to, and during, movement thereof. Should a foreign object be detected, the wall panels 133 do not begin to move or stop moving until the foreign object is no longer detected. In addition, a transparent barrier (e.g., pony wall) (not shown) may be placed adjacent to the moving wall panels 133 to keep persons distanced from the wall panels 133.

In another embodiment, a rigid wall depicts a first theme and one or more wall panels may be raised or lowered to conceal the first theme with new themes depicted on the wall panels.

Figure 7A:
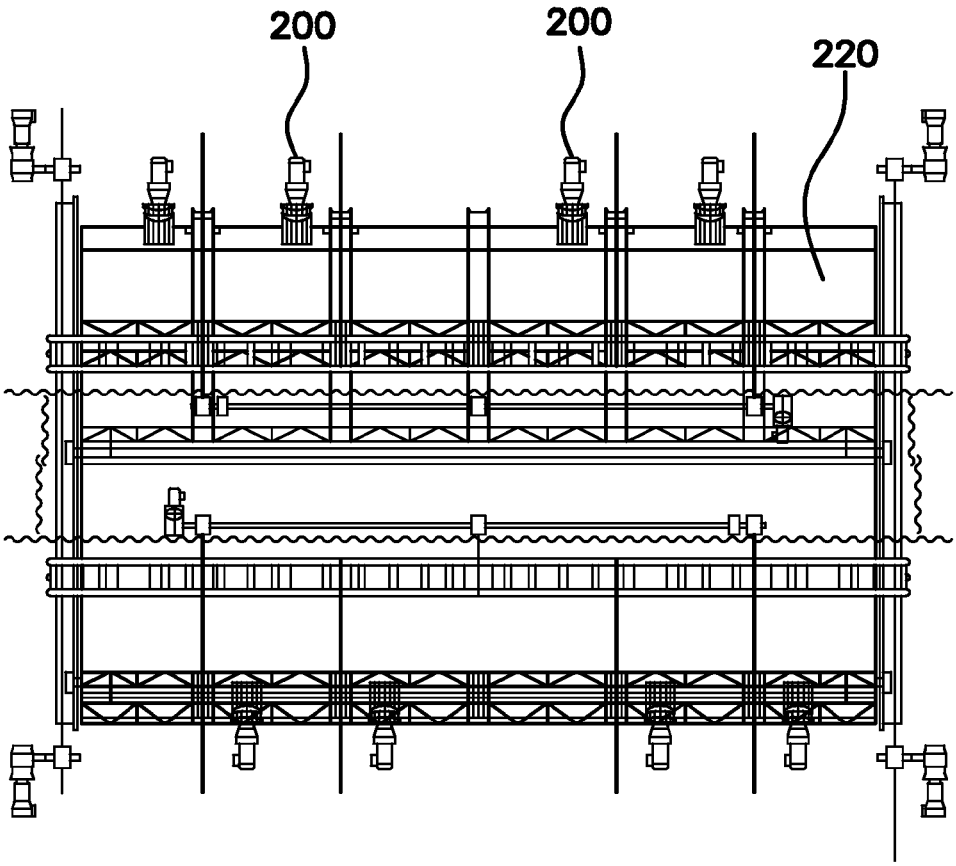
Figure 7B:
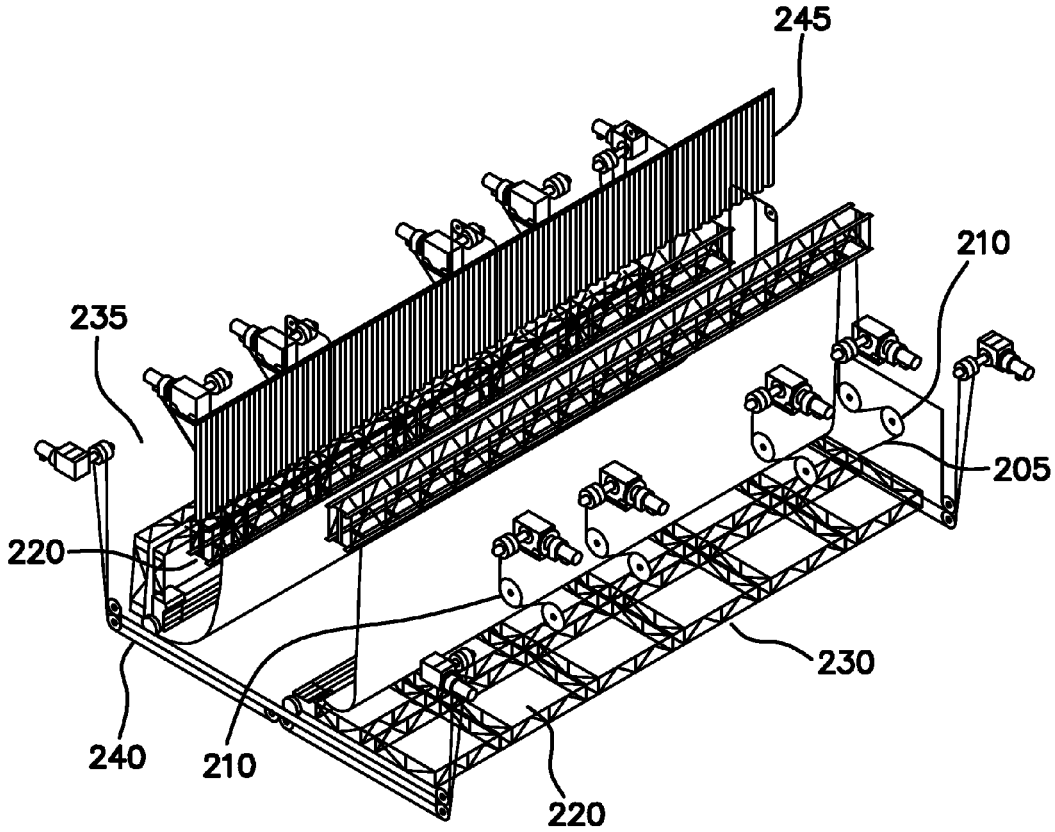
Figure 7C:
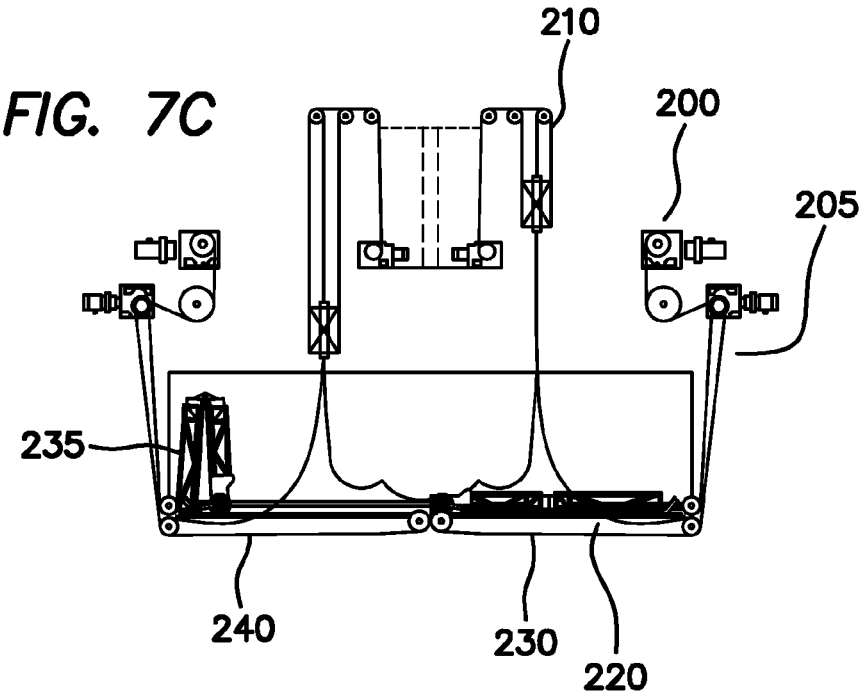
Figure 7E:
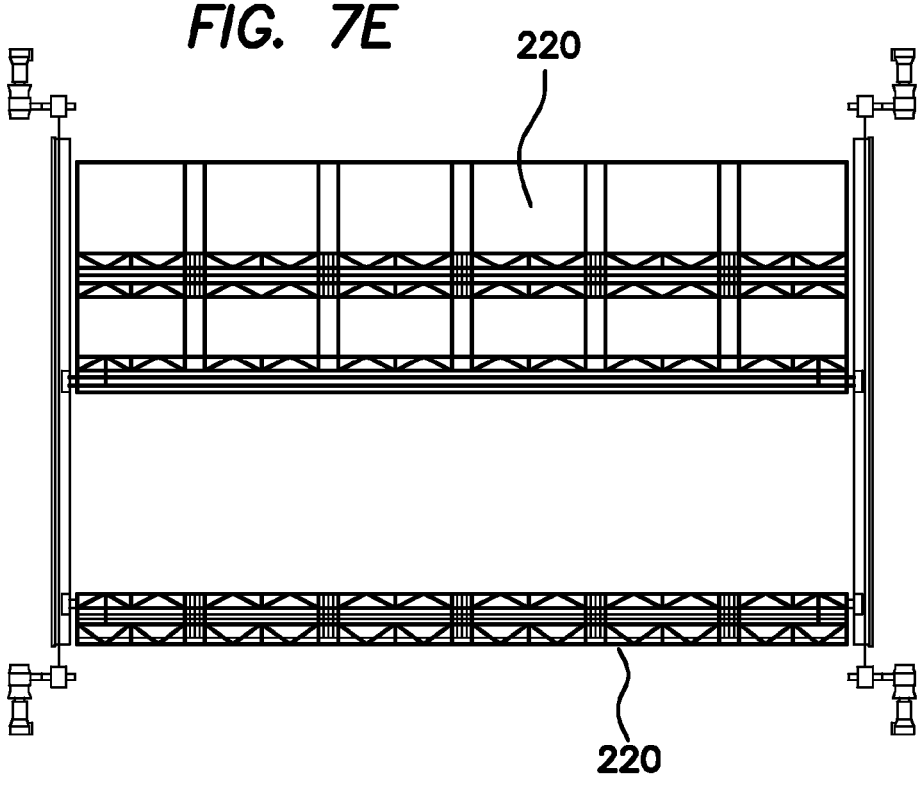
Figure 7D:
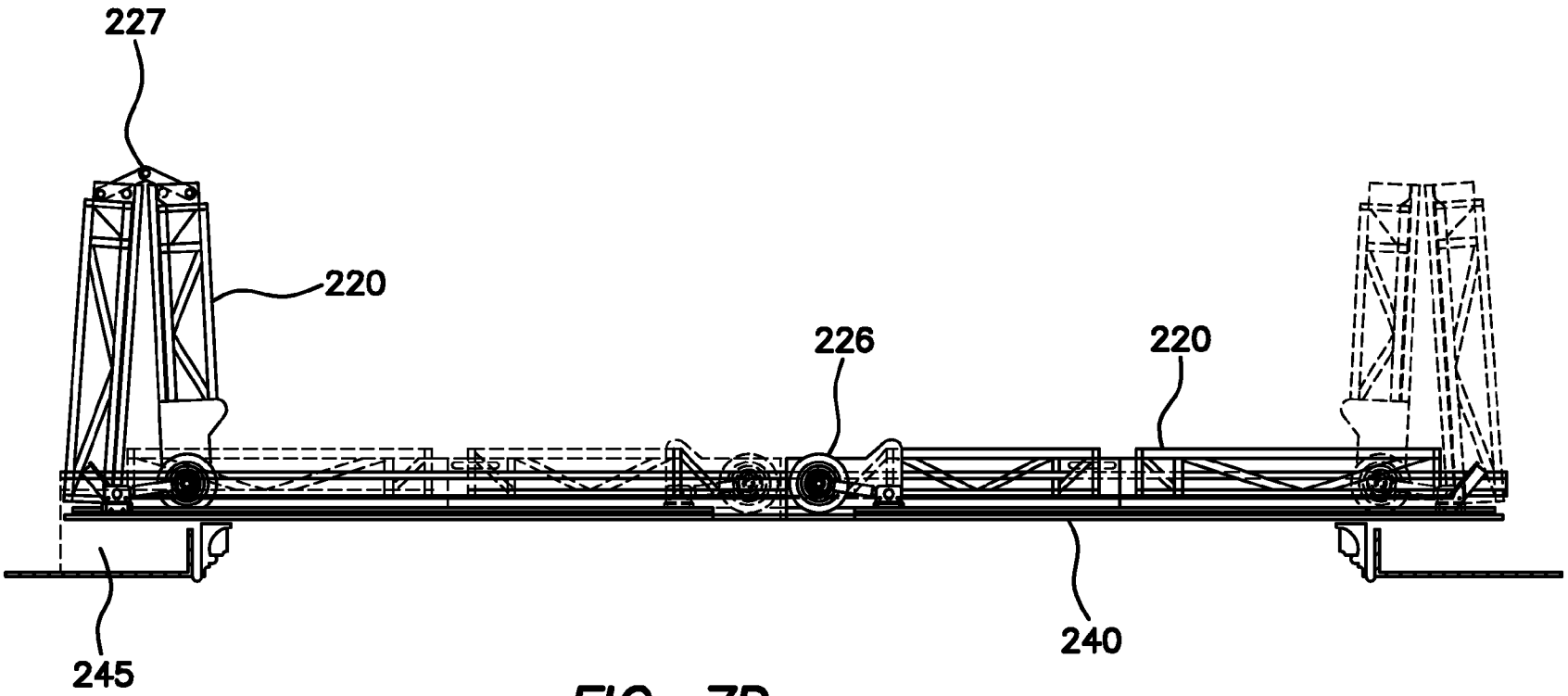

FIGS. 7*a*-7*i* show a first moving ceiling according to the embodiments of the present invention. FIG. 7*a* shows an overhead or plan view of a moving ceiling of one embodiment of the present invention. An upper portion of FIG. 7*a* shows the ceiling in a closed position while the lower portion shows the ceiling in an open position. A series of winches 200, cables 205 and pulleys 210 provide means for moving and positioning ceiling panels 220 which depict a theme associated with the space on a bottom surface thereof. FIGS. 7*b* and 7*c* each show the ceiling in open and closed positions. Opening the ceiling is accomplished by moving said ceiling panels 220 from a horizontal position or closed position 230 to vertical or open position 235. In one embodiment, the ceiling panels 220 are formed of a pair of truss segments 221. The ceiling panels 220 move via guide tracks 240. Once the ceiling panels 220 are in the vertical or open position 235, the ceiling curtains 220 may then be lifted by one of the cables 205 to conceal the displaced ceiling panels 220. A black masking curtain 245 is also held within the ceiling system for deployment when required.

Figure 7H:
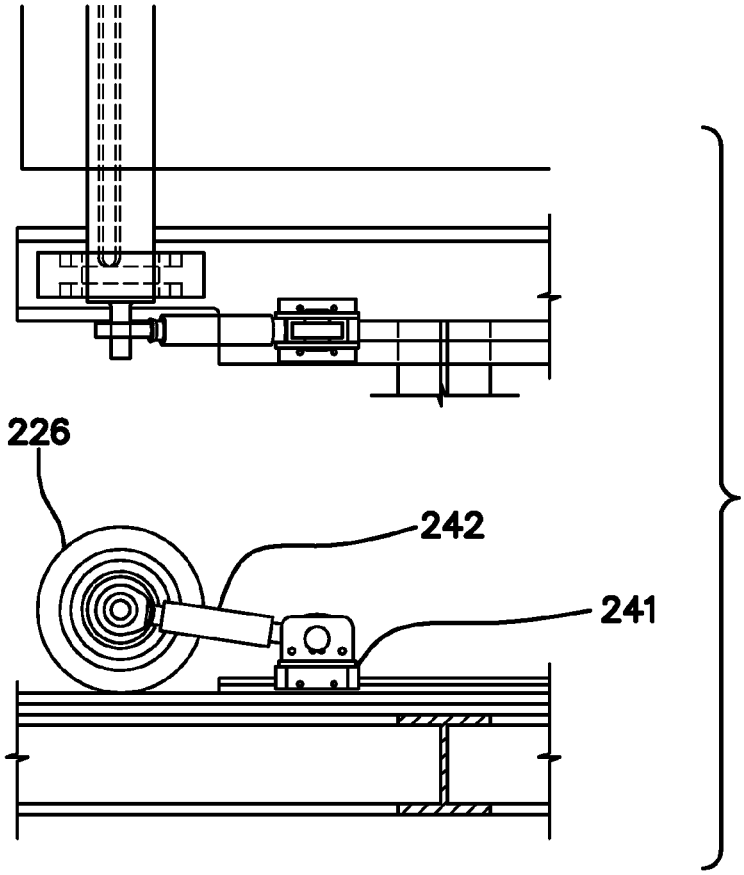
Figure 7I:
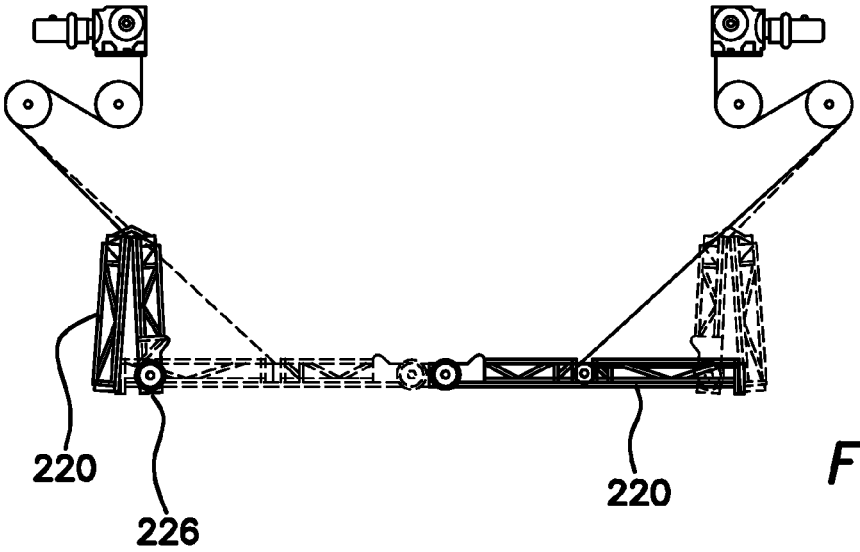
Figure 8A:
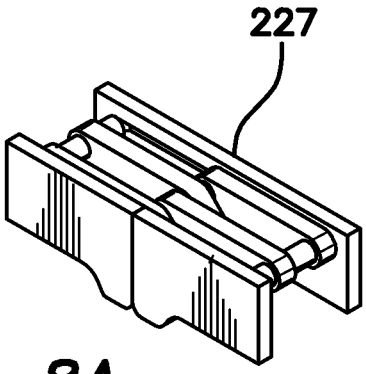
FIGS. 8*a* and 8*b* illustrate a ceiling member hinge in a closed and open position, respectively.
Figure 8B:
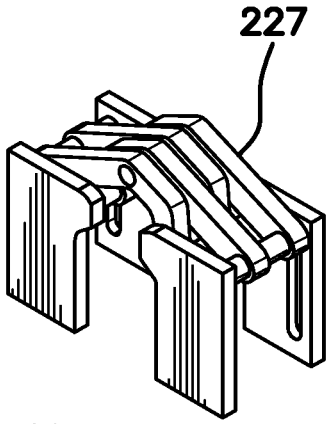

FIGS. 7*d* through 7*i* show detailed views of the configuration of the ceiling panels 220. For clarity, FIGS. 7*d* through 7*i* show various isolated portions the ceiling system. Wheels 226 move along guide tracks 240 permitting the ceiling panels 220 to be opened by moving the linear bearing assemblies or wheels 226 toward an outer edge 245 such that the ceiling panels 220, namely truss segments 221, pivot via hinges 227. Hinge 227 is shown in closed and opened positions, respectively, in FIGS. 8*a* and 8*b*. Moving the wheels 226 is accomplished by using a series of cables 205 to elevate the center of the ceiling panels 220 such that the truss segments 221 of ceiling panels 220 bend upward via the hinges 227. The cables 205 then continue pulling the center portion toward the outer edge 245 until the ceiling panel 220 is in the full upright or open position. As shown in FIG. 7*h*, in one embodiment, the wheels 226 are connected via a drag link 242 to a linear bearing 241 which glides along track 242. A motor may also be used to move the ceiling panels 220 as described above.

Figure 7N:
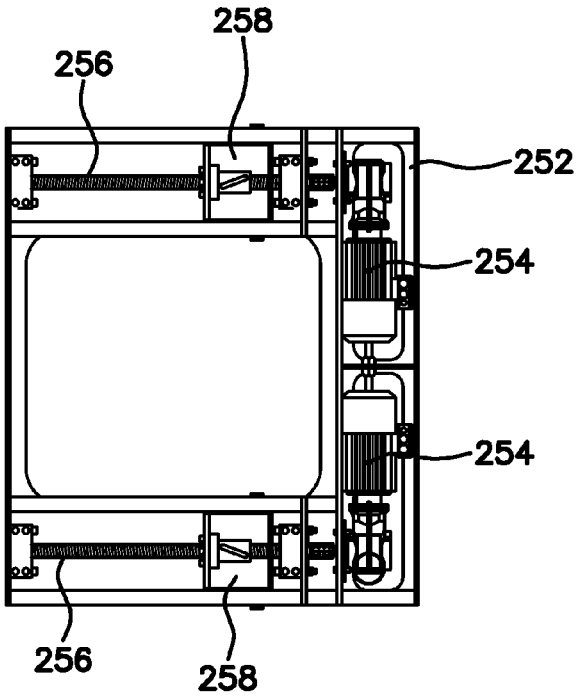
FIGS. 7*n*-7*o* illustrate top and side views, respectively, of driving systems utilized with the second moving ceiling.
Figure 7O:
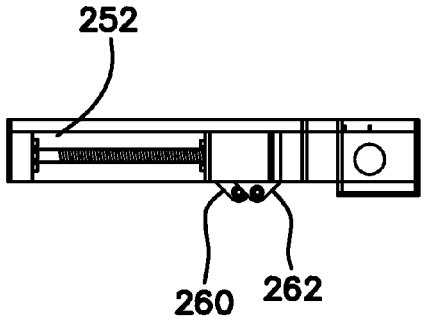
Figure 7M:
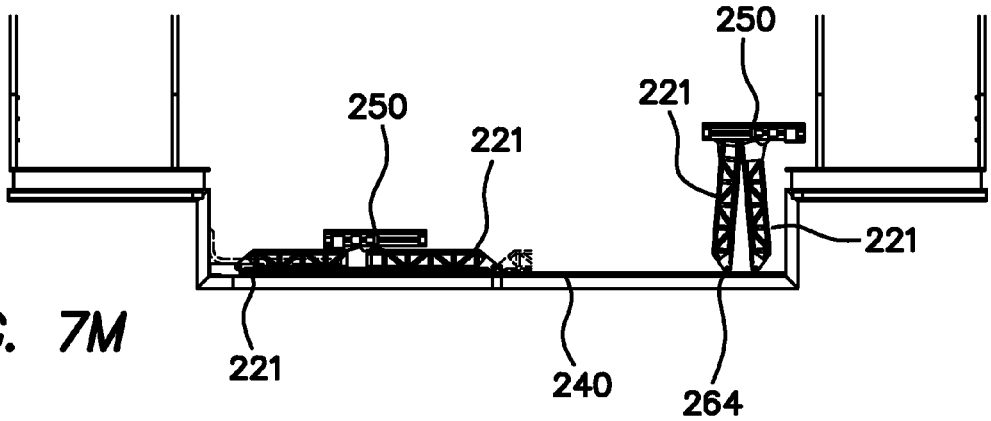

FIGS. 7*j* through 7*m* show a second moving ceiling according to the embodiments of the present invention. FIGS. 7*j* through 7*l* show perspective top views and FIG. 7*m* shows side views of the ceiling panel 220 with a pair of self-contained driving systems 250 on opposite ends thereof. One ceiling panel 220-1 is shown in an open position while a second ceiling panels 220-2 is shown in a closed position. The driving systems 250 function to move the two truss segments 221 about hinges 227 in a similar manner as is accomplished by using the series of cables 205. In this instance, as shown in FIGS. 7*n* and 7*o* each driving system comprises a housing 252 containing a pair of motors 254, nook ball screws 256 and double ball nut 258. The driving systems 250 are attached to the ceiling panels 220 via openings 260 in triangular extensions 262. The driving systems 250 are connected to the truss supports 221 (or an intermediary member) such that as the nook ball screws 226 and double ball nut 258 are driven by the motors 254, the truss supports 221 are pulled toward one another via hinges 227 as linear bearing assemblies or wheels 264 glide along guide tracks 240 until ceiling panels 220 are in an open position as shown in FIGS. 7*j*-7*l*. Operating the nook ball screws 256 and double ball nut 258 in reverse lowers the ceiling panels 220 into a home horizontal position. The driving systems 250 are self-contained and raise and lower with the truss supports 221 as they open and close.

FIGS. 10*a* through 10*e* show a foldable chandelier system 300 which, in one embodiment, is positioned above the ceiling system and revealed when said ceiling system is in an open position. The chandelier system 300 includes a fixed chandelier section 305, foldable chandelier dome 310 and central support rod 315. A winch 320, pulleys or sheaves 325 and chains 330 allow the chandelier to be lowered and raised and separate chandelier leaf members 335 to be raised and lowered as detailed hereinafter. Eight roller chains 330 are supported at a first end by a clew ring 345 and a second end by sprocket arrangements 355 which serves to open and close eight separate leaf members 335. Electrical cable conduits 355 provide electricity to lights supported by, or integrated in, the leaf members 335.

Figure 9A:
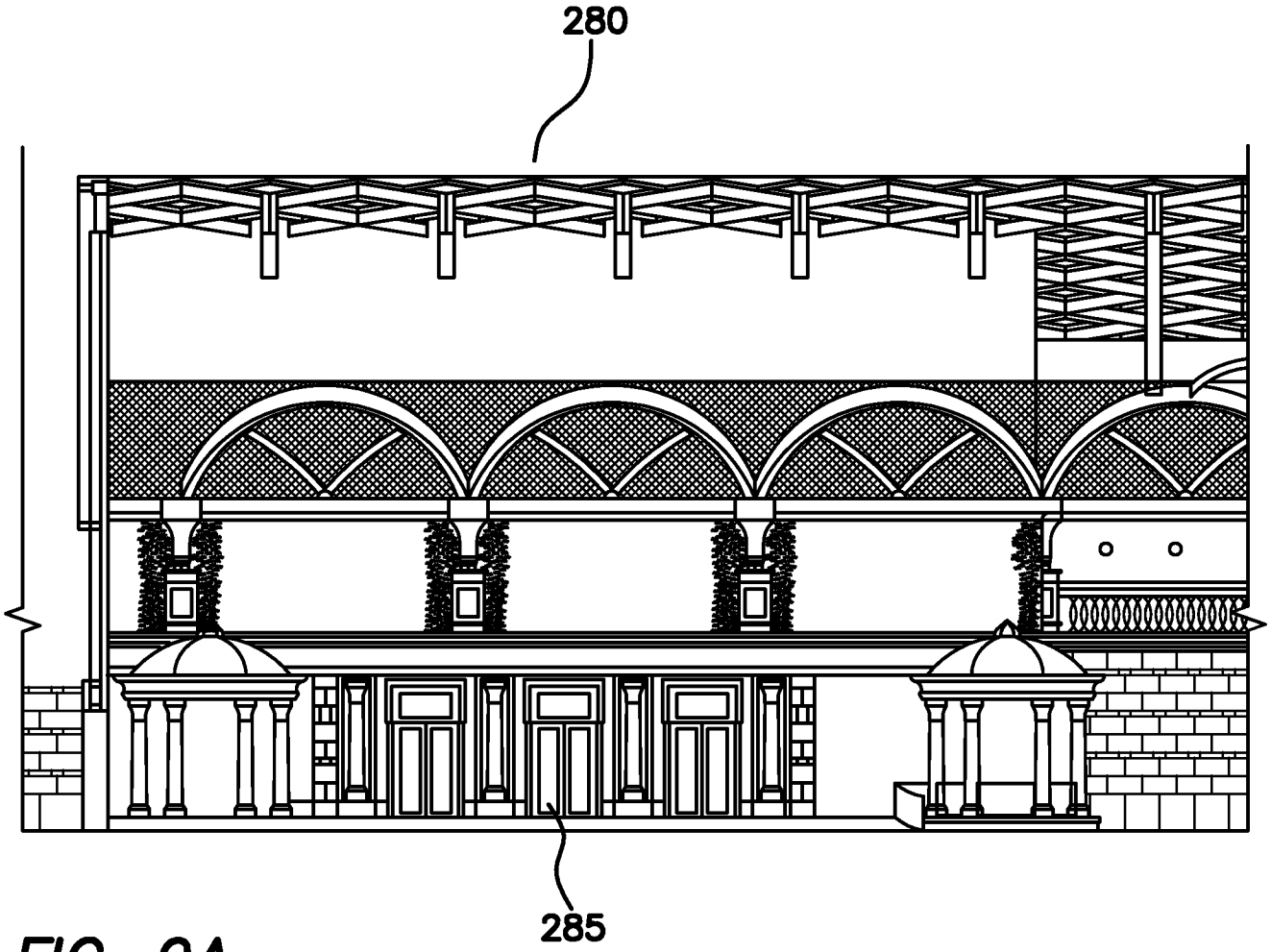
FIGS. 9*a* and 9*b* illustrate different restaurant themes as facilitated by wall panels positioned according to the embodiments of the present invention.
Figure 9B:
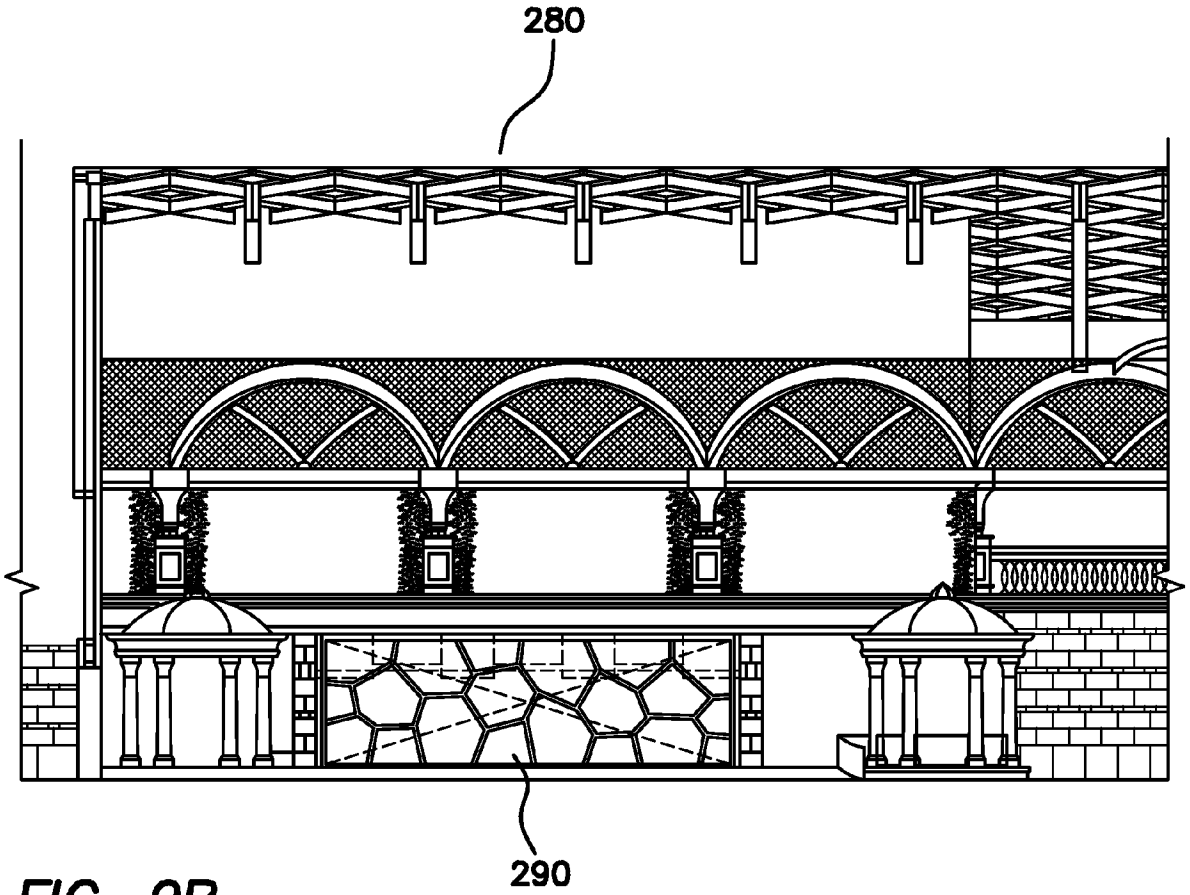

FIGS. 9*a* and 9*b* show actual wall facades 280 with different wall panel designs 285, 290. Those skilled in the art will recognize that any wall panel designs are possible.

Figure 10A:
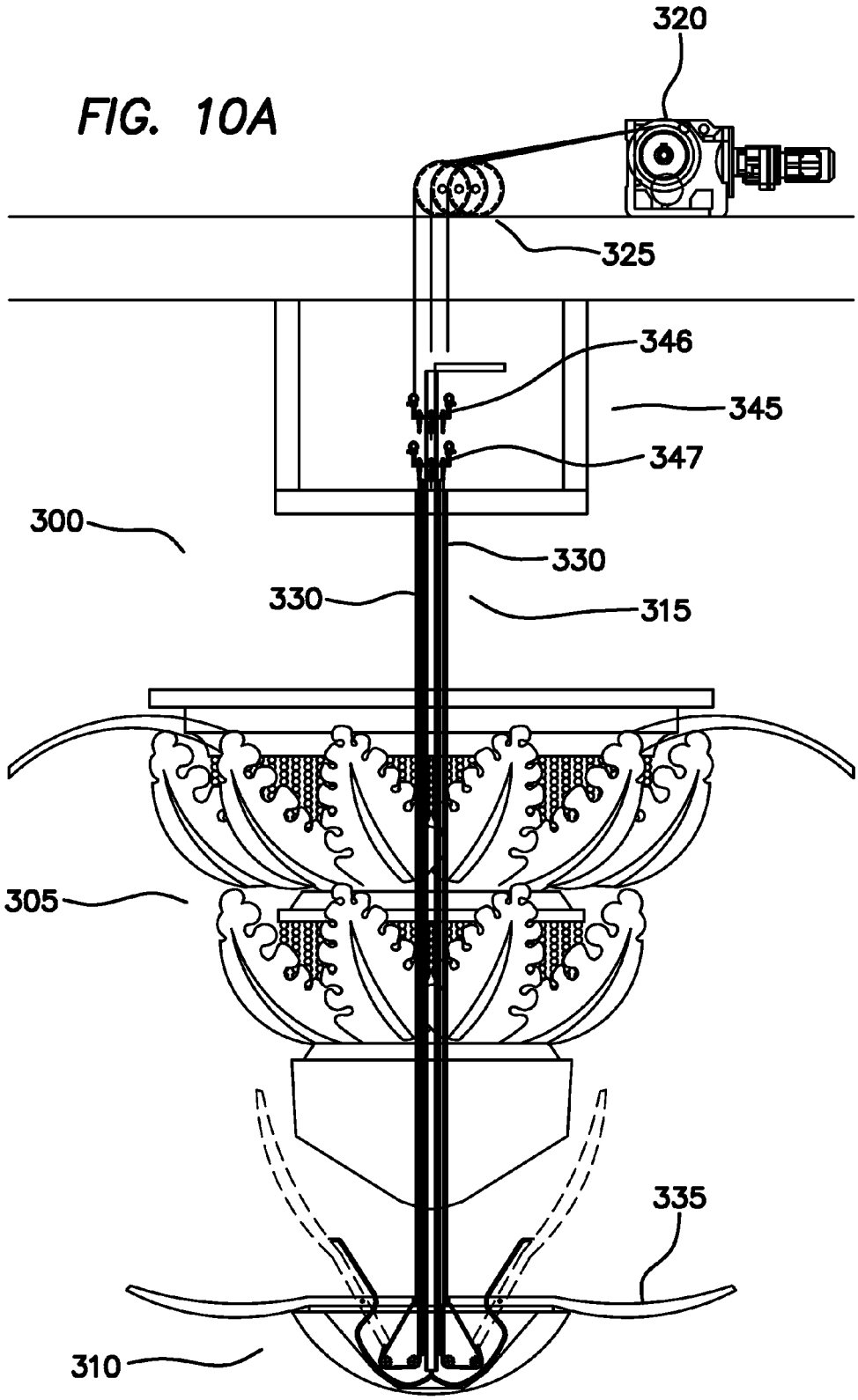
FIGS. 10*a*-10*e* illustrate a foldable chandelier according to the embodiments of the present invention.
Figure 10B:
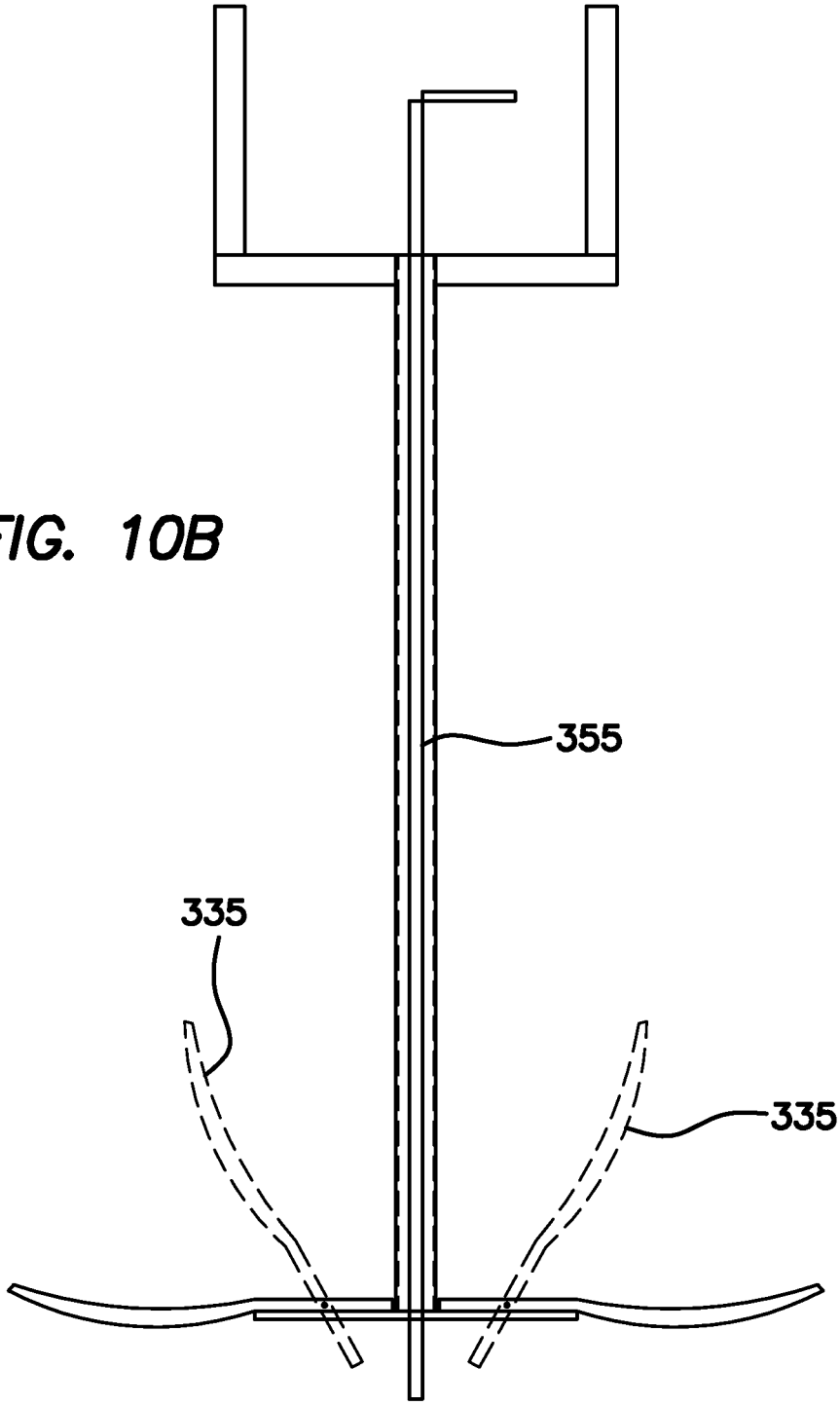
Figure 10C:
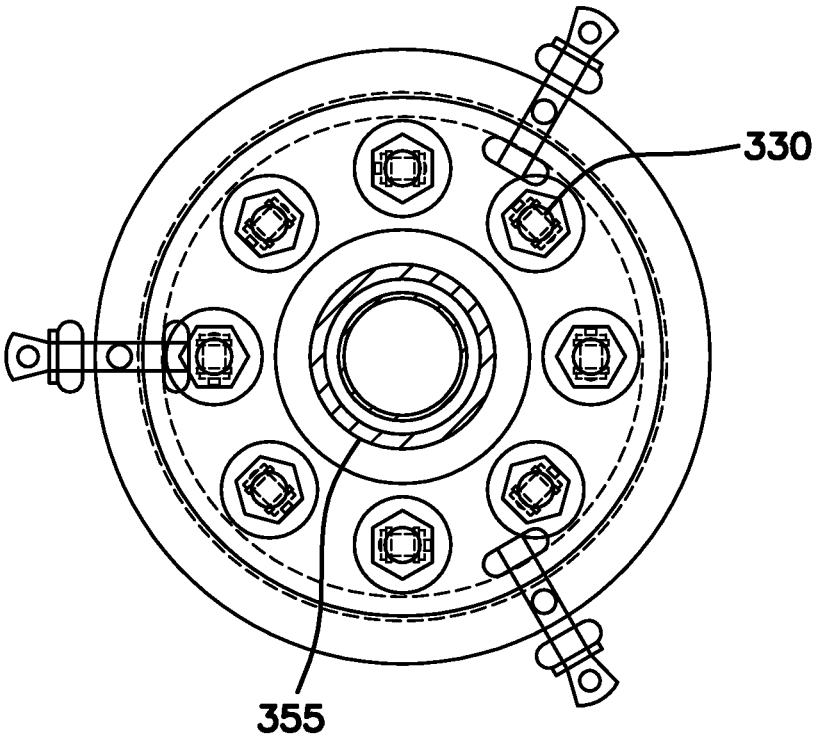
Figure 10D:
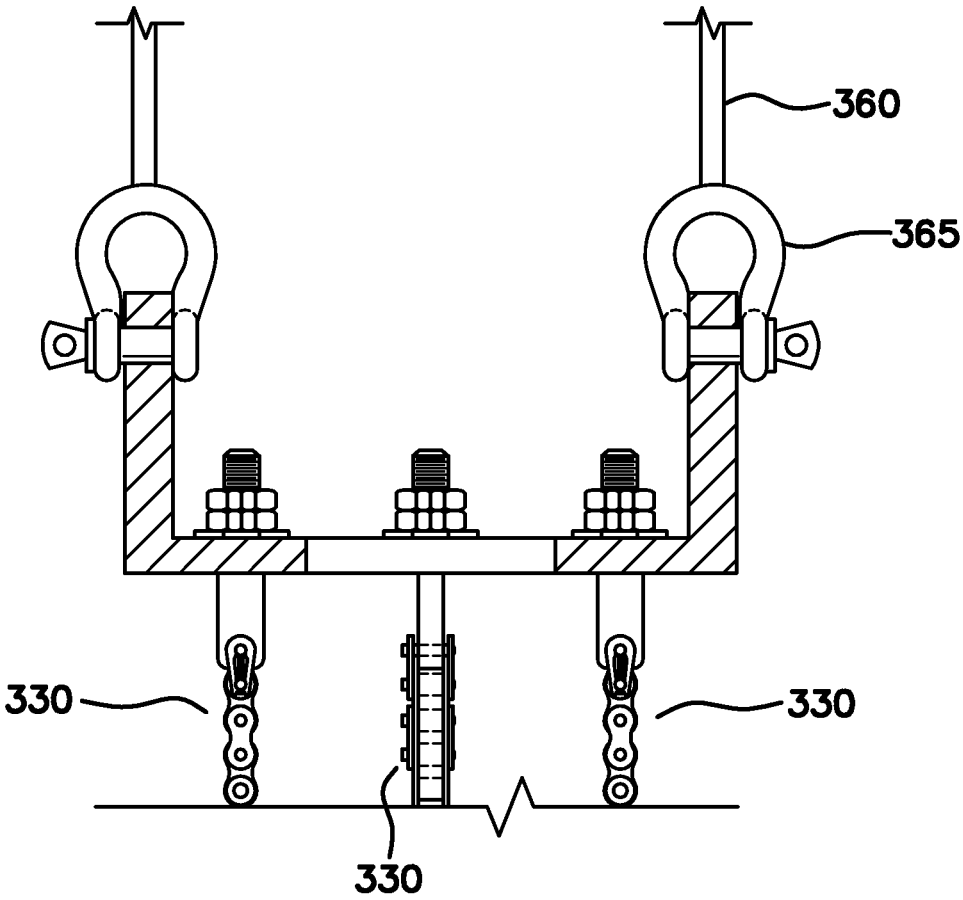
Figure 10E:
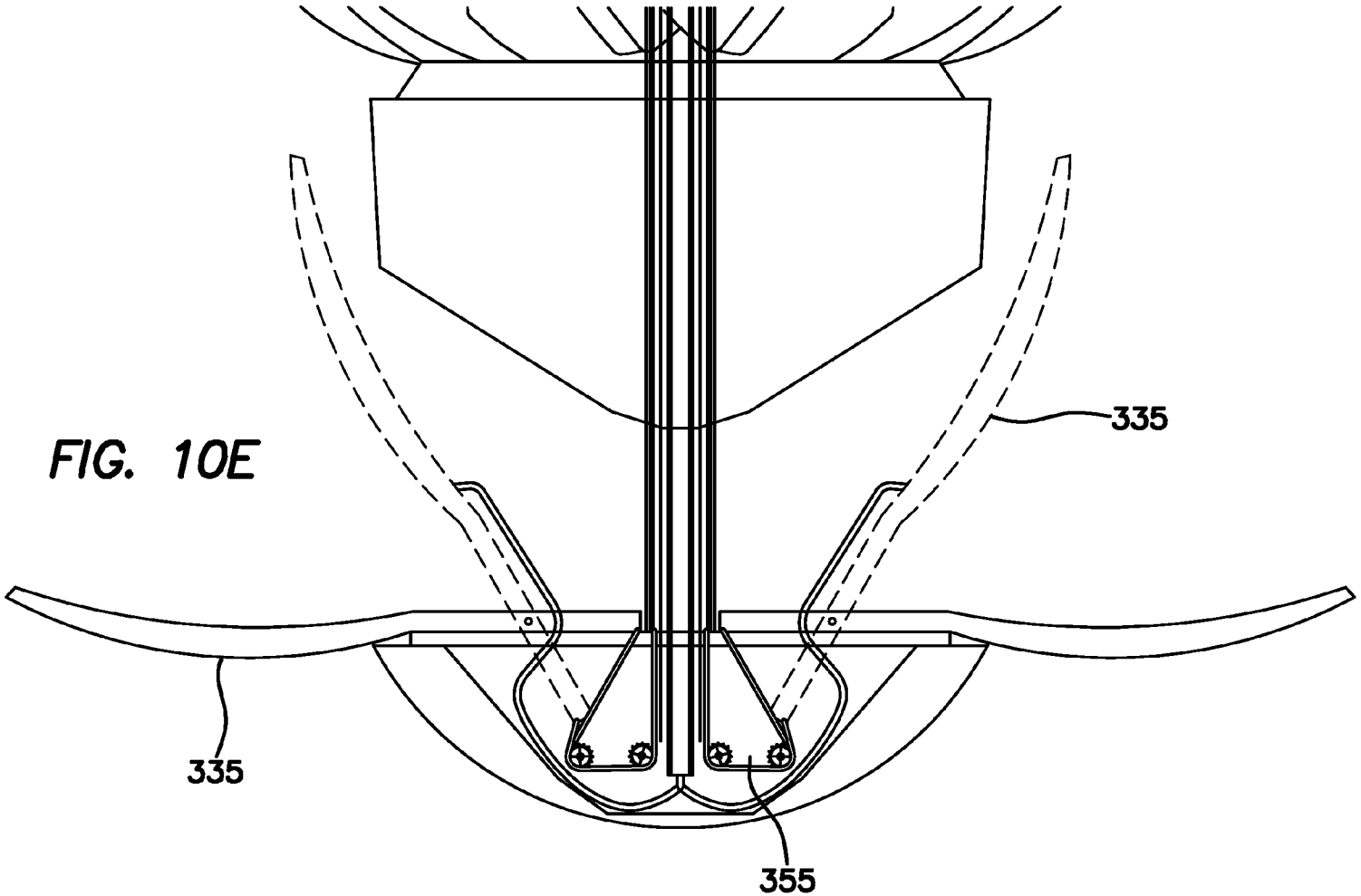

FIGS. 10*c* and 10*d* show detailed top and side views of the clew ring 345, respectively. The clew ring 345 supports eight roller chains 330 which extend downward to sprockets arrangements 355. Wire rope 360 and shackles 365 attach the chandelier system 300 to a rigid ceiling member. FIG. 10*a* shows first and second positions of the clew ring 345 wherein a first position 346 is with the leaf members 355 in a closed position and a second position 347 is with the leaf members 355 in an open position. The winch 320 controls the vertical position of the clew ring 345 and thereby the position of the leaf members 355.

In one embodiment, a computer system (e.g., processor, memory, etc.) is used to control the operation and synchronization of the wall panels, ceiling panels and chandelier. A user may input a rate of theme change, time between theme changes, etc., as desired using a terminal (i.e., keyboard and display) which is then carried out by the computer system which controls the winches and chain drives to accomplish the theme changes. Alternatively, the changes may be triggered manually or responsive to a pre-set timer.

In one restaurant embodiment, an audio and/or visual prelude to theme changes is presented for diners. In this manner, diners are aware of the upcoming theme change and may observe the theme change as it occurs. For example, a visual cue may comprise restaurant lights being dimmed or brightened to announce the pending theme change. Light colors may also be altered to announce the upcoming theme change. Alternatively or additionally, restaurant music may be changed from normal ambiance music to music which has been selected as "theme changing" music or music volume may be turned up. Those skilled in the art will recognize that any audio, visual cues or combinations thereof may be used to alert diners of a pending theme change. Obviously, the same types of cues may be used in non-restaurant facilities utilizing the embodiments of the present invention.

Although the invention has been described in detail with reference to several embodiments, additional variations and modifications exist within the scope and spirit of the invention as described and defined in the following claims.

What is claimed is:

1. A system for changing a theme of a space comprising:
one or more moving ceiling systems positioned to conceal a space thereabove, each moving ceiling system having at least two ceiling panels with a first ceiling panel hinged to a second ceiling panel near a mid-point;
two wheels on one of said two ceiling panels and configured to glide along two guide tracks as said ceiling members are opened and closed; and
means for opening said at least two ceiling panels such that said at least two ceiling panels bend together near said mid-point and move to expose an area thereabove.

2. The system of claim 1 wherein bottom surfaces of said ceiling members depict a theme associated with said space.

3. The system of claim 1 wherein when said ceiling members are in an open position said theme is substantially concealed.

4. The system of claim 1 further comprising a series of light fixtures wherein a portion of said light fixtures are above said ceiling members and a portion of said light fixtures are below said ceiling members.

5. The system of claim 1 further comprising curtain members positioned to conceal said ceiling panels when said ceiling panels are in an open position.

6. The system of claim 1 wherein said means for opening said at least two ceiling members comprising one or more of the following: winch, cable, pulley and chain lift.

7. The system of claim 1 wherein said ceiling panels include wheels positioned to move along guide rails.

8. The system of claim 1 further comprising computer means for controlling the movement of the wall panel.

9. A system for changing a theme of a space comprising:
one or more moving ceiling systems positioned to conceal a space thereabove, each moving ceiling system having at least two ceiling panels with a first ceiling panel hinged to a second ceiling panel near a mid-point; and
a driving system attached to at least one of said ceiling panels for opening said at least two ceiling panels such that said at least two ceiling panels bend together near said mid-point and move along one or more guide tracks to expose an area thereabove, said driving system comprising two wheels on one ceiling panel configured to glide along said one or more guide tracks as said ceiling members are opened and closed.

10. The system of claim 9 wherein bottom surfaces of said ceiling members depict a theme associated with said space.

11. The system of claim 9 wherein when said ceiling members are in an open position said theme is substantially concealed.

12. The system of claim 9 further comprising a series of light fixtures wherein a portion of said light fixtures are above said ceiling members and a portion of said light fixtures are below said ceiling members.

13. The system of claim 9 wherein said means for opening said at least two ceiling members comprising one or more of the following: winch, cable, pulley and chain lift.

14. The system of claim 9 further comprising computer means for controlling the movement of the wall panel.

* * * * *